US007306131B2

(12) United States Patent
Bargo et al.

(10) Patent No.: US 7,306,131 B2
(45) Date of Patent: Dec. 11, 2007

(54) STAPLER WITH ADJUSTABLE PAPER GUIDE

(75) Inventors: Kenneth J. Bargo, Chicago, IL (US); David P. Adams, Barrington, IL (US); Joel G. Delman, Chicago, IL (US); Linda Pulik, Chicago, IL (US); Melanie Lyn Conklin, Brooklyn, NY (US); Clifford Krapfl, Chicago, IL (US); Cory William Worth, San Francisco, CA (US); Stephen John Gaynes, McHenry, IL (US); Michael F. De Rossi, Lindenhurst, IL (US)

(73) Assignee: ACCO Brands USA LLC, Lincolnshire, IL (US)

( * ) Notice: Subject to any disclaimer, the term of this patent is extended or adjusted under 35 U.S.C. 154(b) by 144 days.

(21) Appl. No.: 11/110,644

(22) Filed: Apr. 20, 2005

(65) Prior Publication Data

US 2005/0242151 A1 Nov. 3, 2005

Related U.S. Application Data

(60) Provisional application No. 60/563,851, filed on Apr. 20, 2004.

(51) Int. Cl.
*B25C 5/11* (2006.01)
*B65H 33/04* (2006.01)

(52) U.S. Cl. ..... 227/119; 227/110; 227/120; 227/129; 227/132

(58) Field of Classification Search ..... 227/120, 227/108, 110, 119, 129, 132, 5–7
See application file for complete search history.

(56) References Cited

U.S. PATENT DOCUMENTS

| | | | | |
|---|---|---|---|---|
| 4,113,164 | A * | 9/1978 | Muthenthaller | 227/124 |
| 4,491,260 | A | 1/1985 | Jimena | |
| 5,012,967 | A | 5/1991 | Johansson | |
| 5,330,086 | A | 7/1994 | Shimomura et al. | |
| 5,497,931 | A * | 3/1996 | Nakamura | 227/109 |
| 5,626,275 | A | 5/1997 | Chen | |
| 5,639,007 | A * | 6/1997 | Nakamura | 227/109 |
| 5,657,918 | A | 8/1997 | Shimomura et al. | |
| 5,692,666 | A | 12/1997 | Dallas | |
| 5,791,544 | A | 8/1998 | Fujimaki | |
| 5,803,337 | A | 9/1998 | Fukai et al. | |
| 6,068,173 | A | 5/2000 | Sueda | |
| 6,173,949 | B1 | 1/2001 | Visick et al. | |
| 6,199,852 | B1 | 3/2001 | Visick et al. | |
| 6,484,921 | B2 * | 11/2002 | Hakozaki et al. | 227/2 |
| 6,547,119 | B2 | 4/2003 | Huang | |
| 6,565,075 | B2 | 5/2003 | Ishizaki | |
| 6,626,346 | B2 * | 9/2003 | Jairam et al. | 227/127 |
| 6,676,002 | B2 * | 1/2004 | Jairam et al. | 227/154 |
| 6,776,321 | B2 * | 8/2004 | Jairam et al. | 227/134 |

(Continued)

*Primary Examiner*—Brian D. Nash
(74) *Attorney, Agent, or Firm*—Michael Best & Friedrich LLP

(57) ABSTRACT

A stapler having a housing and a throat defined by the housing and configured to receive a stack of sheets for stapling. The throat separates the housing into a head portion and a base portion. A paper guide is coupled to the stapler, the paper guide being movable between a recessed position within the base portion and an extended position. Insertion of the stack of sheets into the throat does not cause movement of the paper guide.

31 Claims, 13 Drawing Sheets

U.S. PATENT DOCUMENTS 6,925,849 B2 * 8/2005 Jairam ..... 72/476
6,981,627 B2 * 1/2006 Tsai ..... 227/155
2005/0017051 A1 * 1/2005 Adams et al. ..... 227/151
2006/0016848 A1 1/2006 Basti

* cited by examiner

STAPLER WITH ADJUSTABLE PAPER GUIDE

RELATED APPLICATIONS

This application claims priority to U.S. Provisional Patent Application No. 60/563,851, Apr.20, 2004, the entire contents of which is incorporated by reference herein.

FIELD OF THE INVENTION

The invention relates to staplers. More specifically, the invention relates to staplers having a paper guide mechanism.

BACKGROUND OF THE INVENTION

Most manual and powered staplers include a throat into which a stack of sheets is inserted for stapling. With manual staplers, the user places the stack of sheets into the throat and pushes the actuation arm of the stapler to eject the staple into the stack of sheets. The user typically will have only a rough idea of where the staple will be located with respect to the stack of sheets.

With many electric staplers, the stapling action is triggered when the stack of sheets engages an actuation lever or trips a photosensor somewhere in the throat of the stapler. The user often does not know exactly where the actuation lever or photosensor is, and therefore does not know exactly when the stapling will occur. This makes precise placement of the staple with respect to the stack of sheets difficult.

SUMMARY OF THE INVENTION

The present invention provides a stapler having one or more paper guide devices that extend out of the base and/or the head of the stapler to assist the user in guiding the stack of sheets into the stapler's throat for stapling. The paper guide devices help the user position the stack of sheets in the throat to achieve the desired staple position in the stack of sheets.

More particularly, the invention provides a stapler including a housing, and a throat defined by the housing and configured to receive a stack of sheets for stapling. The throat separates the housing into a head portion and a base portion. A paper guide is coupled to the stapler such that the paper guide is movable between a recessed position within the base and an extended position. Insertion of the stack of sheets within the throat does not cause movement of the paper guide.

In one embodiment, movement of the paper guide results from engagement of the paper guide with another portion of the stapler. In another embodiment, the stapler includes an adjustable throat depth guide mounted within the throat. In another embodiment, the paper guide includes first and second paper guides, the first and second paper guides being independently movable between the recessed and extended positions. In another embodiment, the stapler includes a gear train mounted within the base portion of the stapler, and a cam member coupled to the gear train such that rotation of the gears in the gear train causes rotation of the cam member and the cam member engages with the paper guide to move the paper guide between the recessed and extended positions.

Other features and advantages of the invention will become apparent to those skilled in the art upon review of the following detailed description, claims, and drawings.

Figure 1:
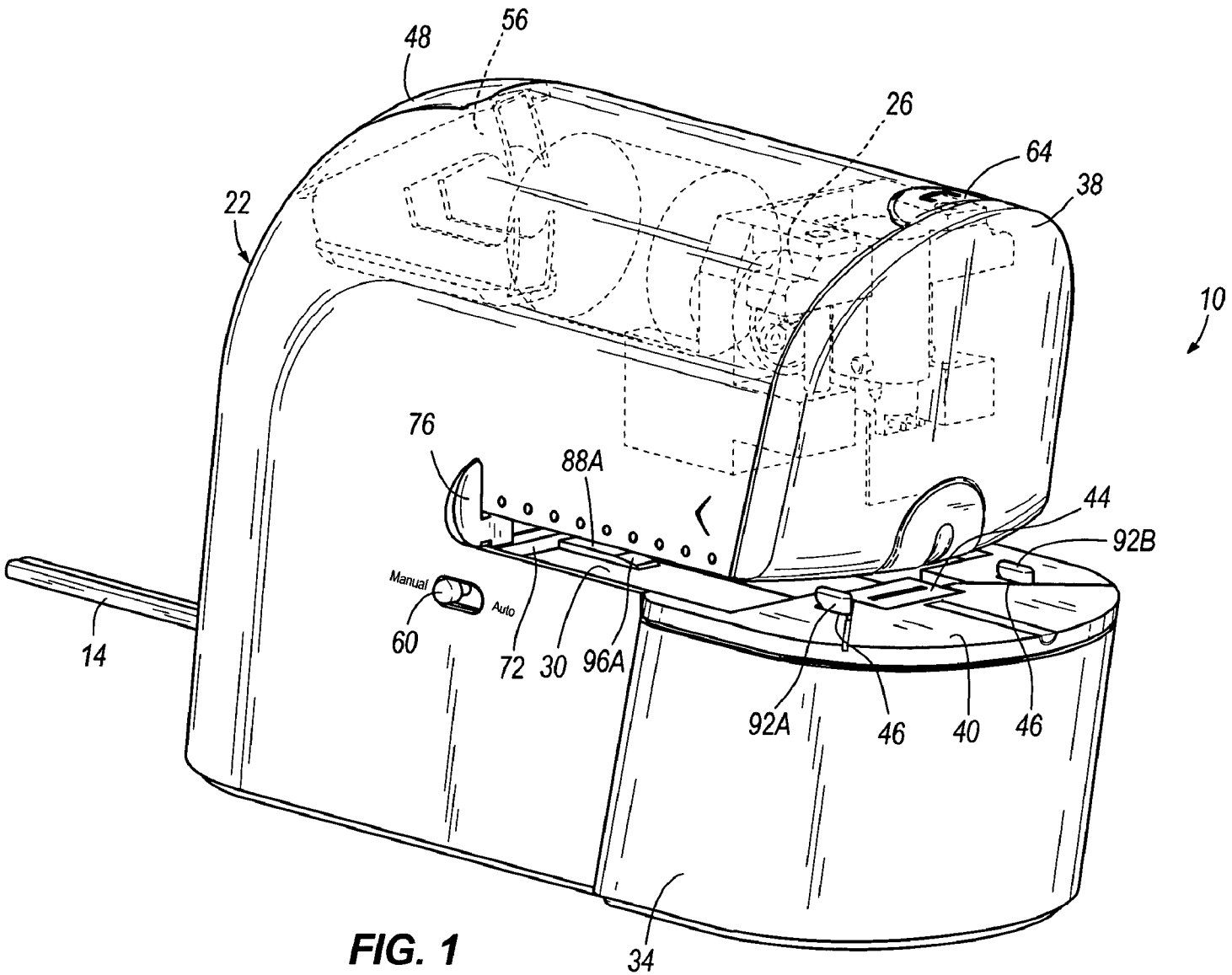
FIG. 1 is a perspective view of a stapler embodying the invention.

Before one embodiment of the invention is explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting. The use of "including," "having," and "comprising" and variations thereof herein is meant to encompass the items listed thereafter and equivalents thereof as well as additional items.

DETAILED DESCRIPTION OF THE PREFERRED EMBODIMENT

FIG. 1 illustrates a stapler 10 embodying the invention. In the illustrated embodiment, the stapler 10 is a desktop-type powered stapler. However, the invention is not limited to desktop-type powered staplers, and could be practiced with other powered staplers and even with manual staplers.

The illustrated stapler 10 is configured to operate under AC to DC power provided by electrical cord 14. In other embodiments, a stapler according to the invention can be configured to operate under DC power provided by batteries (not shown). The stapler 10 includes a housing 22 that at least partially surrounds and encloses the stapler engine or drive mechanism 26, shown in phantom in FIG. 1. The drive mechanism 26 can take any suitable form and will not be described in greater detail.

The housing 22 defines a stack insertion throat 30 into which a stack of sheets (not shown) is inserted for stapling. The throat 30 separates the housing into a base portion 34 and a head portion 38. The base portion 34 of the housing 22 carries or defines a sheet support surface 40 and an anvil 44 that together define at least part of the lower surface of the throat 30. It is understood that in other embodiments the base portion 34 can include an active clincher assembly that clinches the staple legs after they are driven through the stack of sheets and still fall within the scope of the present invention. The base portion 34 also includes two apertures 46, the function of which will be described in detail below.

The head portion 38 at least partially surrounds the drive mechanism 26 and includes a door 48 that opens to the inside of the head portion 38. A companion device, such as a staple remover 56, also shown in phantom in FIG. 1, can be housed within the head portion 38. A stapler having similar storage capabilities is described in co-pending U.S. Patent application Ser. No. 11/097,090 entitled "Stapler with Detachable Accessory," the entire contents of which is incorporated by reference herein.

The stapler 10 of the illustrated embodiment is operable in an automatic mode or a manual mode. A switch 60, movable by a user of the stapler, is provided on the stapler 10 to allow the user to change between the automatic and manual stapler mode. In the manual mode, the user actuates the staple drive mechanism 26 by depressing a stapling button 64 when the stack of sheets is in the desired position. In the automatic mode, the staple driving mechanism 26 is actuated when the stack of sheets contacts an internal switch 68 (shown in FIG. 2A). In the illustrated embodiment, the internal switch 68 is a spring-trigger actuation lever. However, it is understood that in other embodiments the internal switch could include a photosensor or other suitable means for actuating the drive mechanism 26.

Figure 2A:
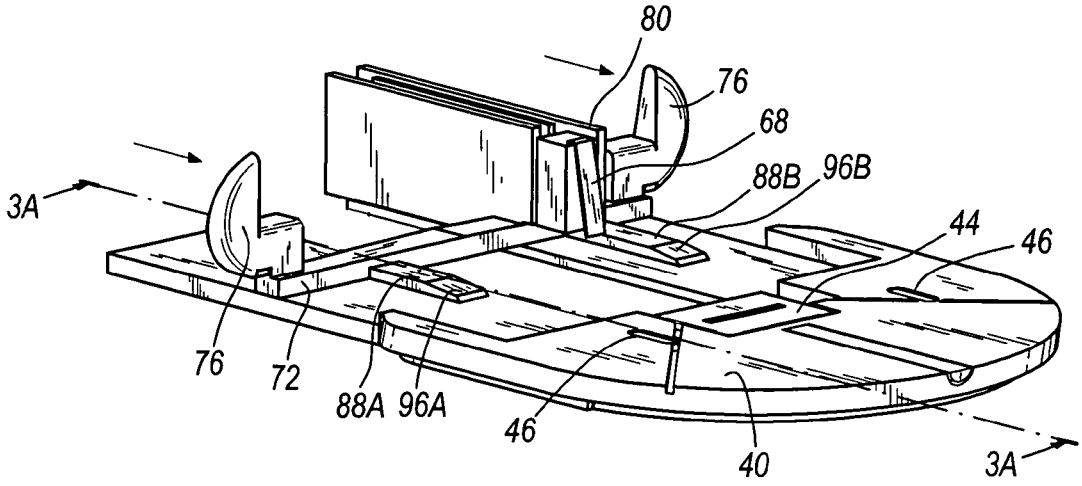
FIG. 2A is a perspective view of a sheet support surface of the stapler of FIG. 1, including a throat depth guide in a rearward position.
Figure 2B:
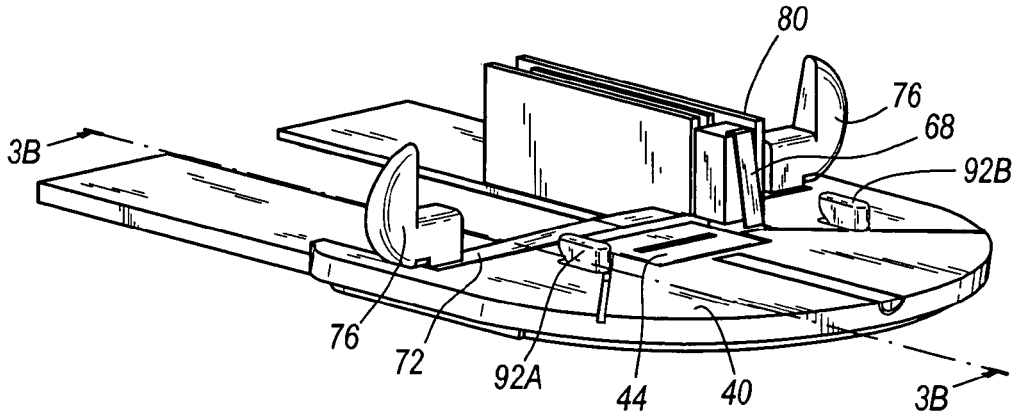
FIG. 2B is a perspective view similar to FIG. 2A, showing the throat depth guide in a forward position.

With reference to FIGS. 1-3, the stapler 10 also includes a throat depth adjuster 72 mounted to the sheet support surface 40. The throat depth adjuster 72 allows the user to vary the depth at which the staple is inserted into the stack from an edge of the stack of sheets, while ensuring that the user is able to determine when the staple will be actuated. The throat depth adjuster 72 includes two adjustment members 76 that are positioned on the outside of the head portion 38 of the housing 22 and can be grasped by the user to facilitate adjusting the adjuster 72. The adjustment members 76 function as a position switch, as will be described below. The adjuster 72 can be slid along the sheet support surface 40 between a rearward position, as shown in FIG. 2A, and a forward position, as shown in FIG. 2B.

The internal switch 68 is coupled to and moves with the adjuster 72. The adjuster 72 further includes a support wall 80 located adjacent the internal switch 68 to support the internal switch 68 and to direct the movement of the adjuster 72 within the housing 22.

The adjuster 72 also includes two lifting members 88A, 88B that actuate two paper guides 92A, 92B housed within the base portion 34. The lifting members 88A, 88B are substantially similar in construction and operation, and thus only the interaction between the lifting member 88A and the paper guide 92A is shown in detail in FIGS. 3A and 3B. In the illustrated embodiment, the paper guides 92A, 92B are not symmetrical about the anvil 44 (i.e., the paper guides 92A, 92B are staggered when you look at the stapler 10 from the side). Thus, the lifting member 88B is longer than the lifting member 88A in order to reach and cooperate with the paper guide 92B. It is understood that in other embodiments, the paper guides 92A, 92B can be symmetrical in placement about the anvil 44 such that the paper guides 92A, 92B are not staggered and thus, the paper guides 92A, 92B lifting members 88A, 88B would be mirror images of each other.

Figure 3A:
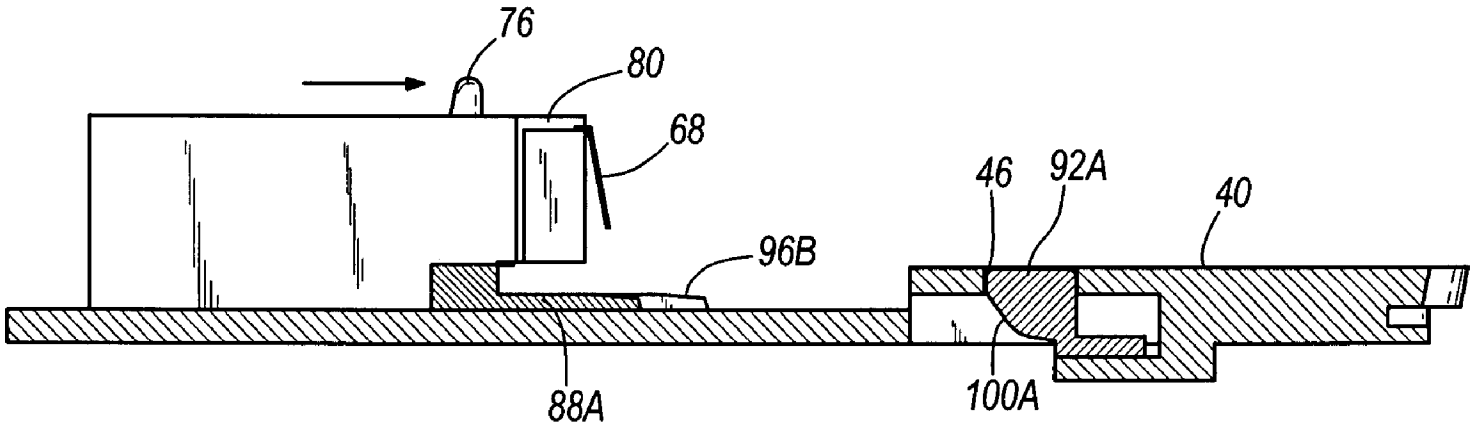
FIG. 3A is a section view of FIG. 2A taken along line 3A-3A.
Figure 3B:
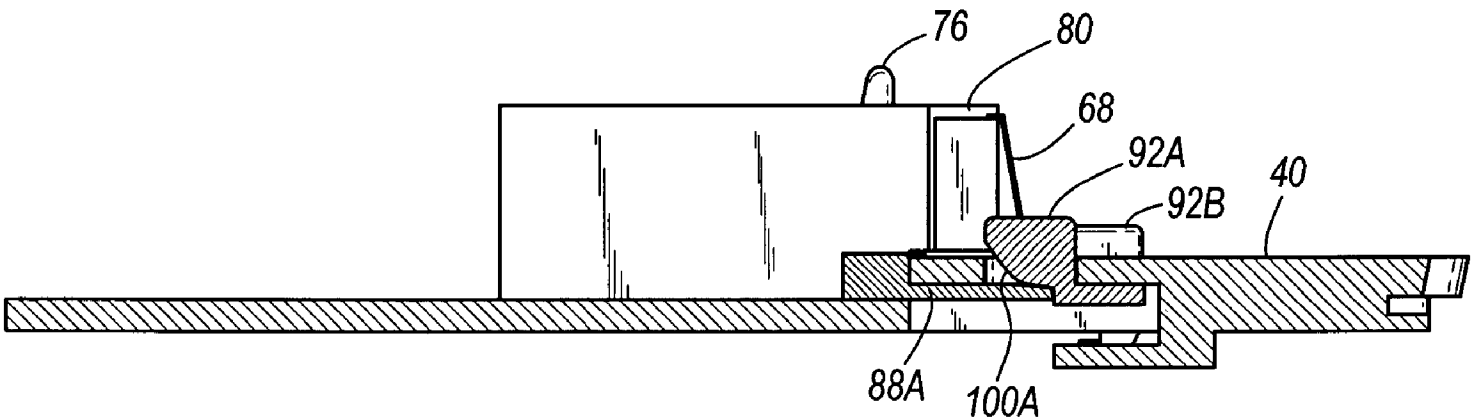
FIG. 3B is a section view of FIG. 2B taken along line 3B-3B

The lifting members 88A, 88B have a ramped forward surface 96A, 96B that acts as a cam when the lifting members 88A, 88B come into contact with the lower cam surface 100A, 100B of the paper guides 92A, 92B. The paper guides 92A, 92B are recessed below the sheet support surface 40 when the adjuster 72 is in the rearward position, as illustrated in FIG. 3A. With reference to FIGS. 2A-3B, as the adjuster 72 is moved from the rearward position to the forward position, the forward surfaces 96A, 96B of the lifting members 88A, 88B contact the lower cam surfaces 100A, 100B of the paper guides 92A, 92B and lift them so that they are extended through the apertures 46 in the base portion 34 in the extended position (shown in FIGS. 2B and 3B). Thus, the user changes the position of the paper guides 92A, 92B by manually adjusting the adjustment members 76 to move the adjuster 72 along the support surface 40.

The user can thus use the paper guides 92A, 92B to align the edges of the stack of sheets to be stapled in a desired position before a staple is actuated by the drive mechanism 26. When the adjuster 72 is returned to the rearward position, the lifting members 88A, 88B disengage with the lower surface 100A, 100B, and the paper guides 92A, 92B fall back through the apertures 46 into the recessed position shown in FIGS. 2A and 3A.

Figure 4:
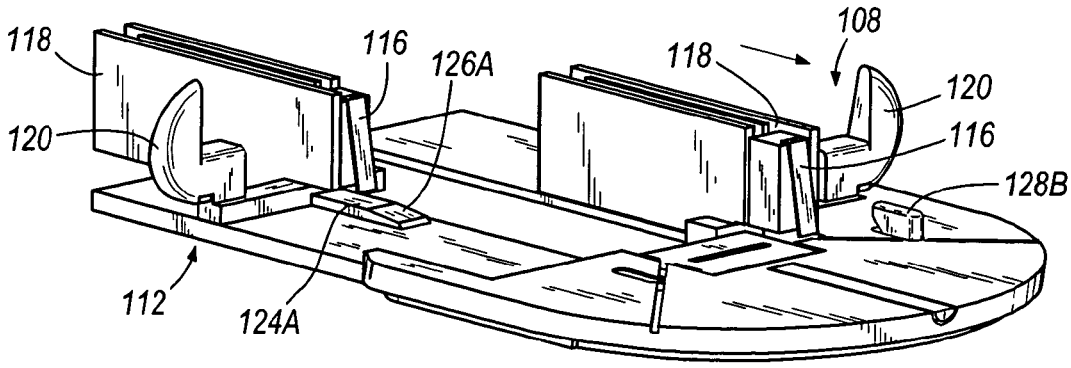
FIG. 4 is a perspective view of another stapler embodying aspects of the present invention and having two throat depth guides.

FIG. 4 illustrates another depth adjuster 104 according to the invention. The depth adjuster 104 includes a right side 108 and a left side 112 that can be independently actuated by the user. Each of the right side 108 and left side 112 includes an internal switch 116 and each includes an adjustment member 120. Each also includes a lifting member 124A, 124B that raises a paper guide 128A, 128B when in the forward position. When the user desires only one of the paper guides 128 to be raised, the user can slide either the right or left side 108, 112 forward such that the lifting member 124A, 124B of that side lifts the paper guide 128A, 128B in a manner similar to that described above with respect to FIGS. 2A-3B. FIG. 4 illustrates the right paper guide 128B in the extended position. Thus, the paper guides 128A, 128B are movable through a first configuration in which the right paper guide 128B is in the extended position, a second configuration in which the left paper guide 128A is in the extended position, and a third configuration in which both the paper guides 128A, 128B are in the extended position. Each of the first, second, and third configurations can guide the stack of sheets into the throat to receive a staple from the stapler in a different staple orientation.

Figure 5A:
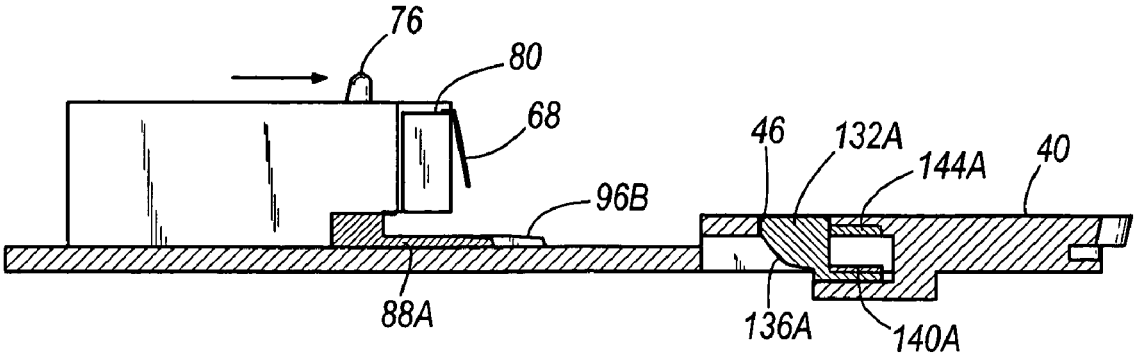
FIG. 5A is a section view similar to FIG. 3A of an alternative embodiment of a paper guide with the throat depth guide in the rearward position and the paper guide in the recessed position.
Figure 5B:
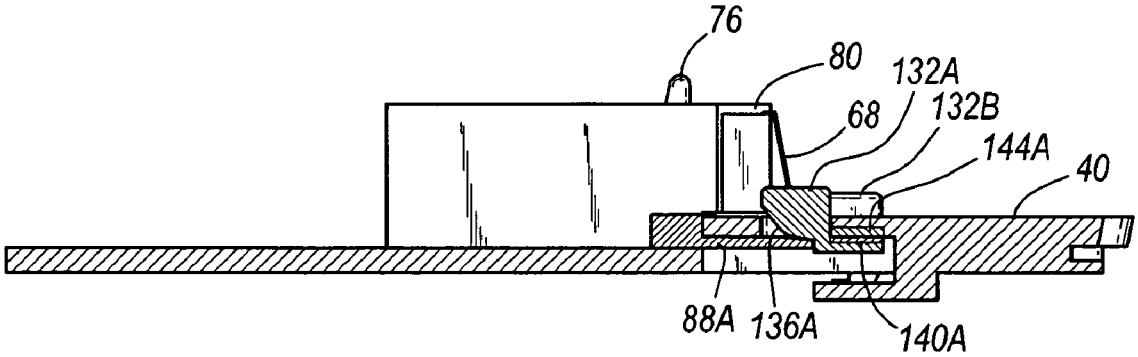
FIG. 5B is the section view of FIG. 5A with the throat depth guide in the forward position and the paper guide in the upright position.
Figure 5C:
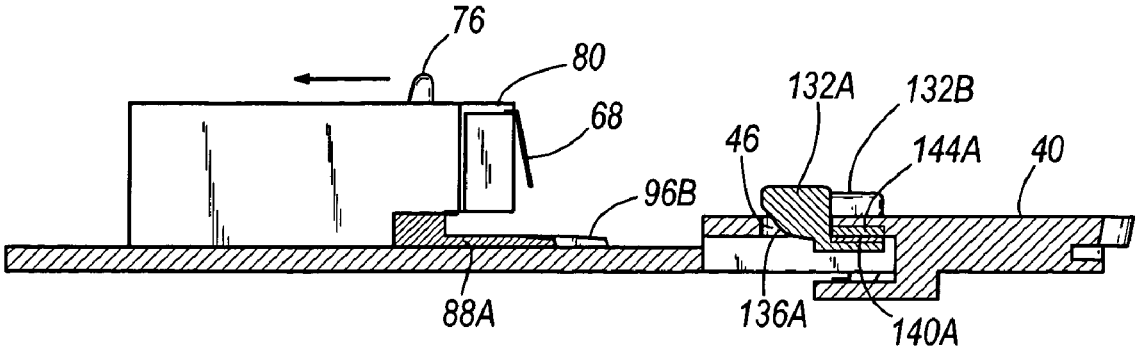
FIG. 5C is the section view of FIG. 5A with the throat depth guide in the rearward position and the paper guide in the upright position.

FIGS. 5A-5C illustrate the depth adjuster 72 described above for use with alternative paper guides 132A, 132B according to the invention. The paper guides 132A, 132B are substantially similar in construction and operation, and thus only the paper guide 132A is shown in detail in FIGS. 5A-5C.

The paper guides 132A, 132B include a lower cam surface 136A, 136B and a magnetic surface 140A, 140B. The paper support surface 40 includes a cooperating magnetic portion 144A, 144B such that when the paper guides 132A, 132B are lifted into the extended position, as shown in FIGS. 5B and 5B, the magnetic surface 140A, 140B of the paper guides 132A, 132B cooperates with the magnetic portion 144A, 144B of the paper support surface 40 to hold the paper guides 132A, 132B in the extended position when the depth adjuster 72 is returned to the rearward position (see FIG. 5C). This allows the user to utilize the paper guides 132A, 132B while the depth adjuster 72 is set to receive the stack of sheets deeper within the throat 30.

If the user wishes to return the paper guides 132A, 132B to the recessed position, the user simply presses the paper guides 132A, 132B downwardly to break the magnetic bond between the magnetic surface 140A, 140B and magnetic portion 144A, 144B, allowing the paper guides 132A, 132B to fall through the recesses 46 into the base 34. It is understood that in other embodiments, the paper guides 132A, 132B could be held in the extended position by something other than the magnetic material and still fall within the scope of the invention, such as by the cooperation of hook and loop material, by an adhesive, by a detent mechanism, by friction, or by other appropriate means.

Figure 6:
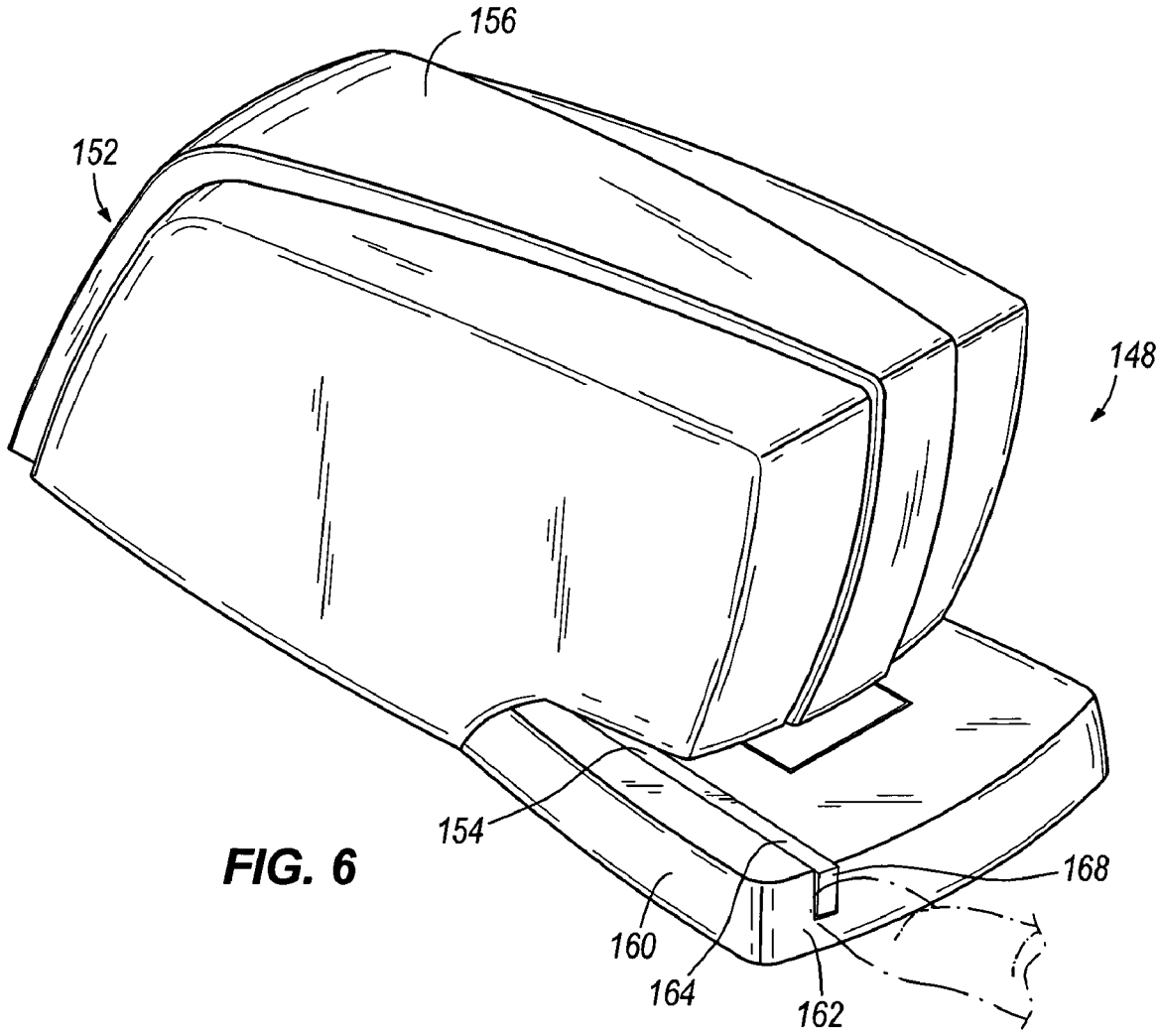
FIG. 6 is a perspective view of another stapler embodying aspects of the present invention.
Figure 7A:
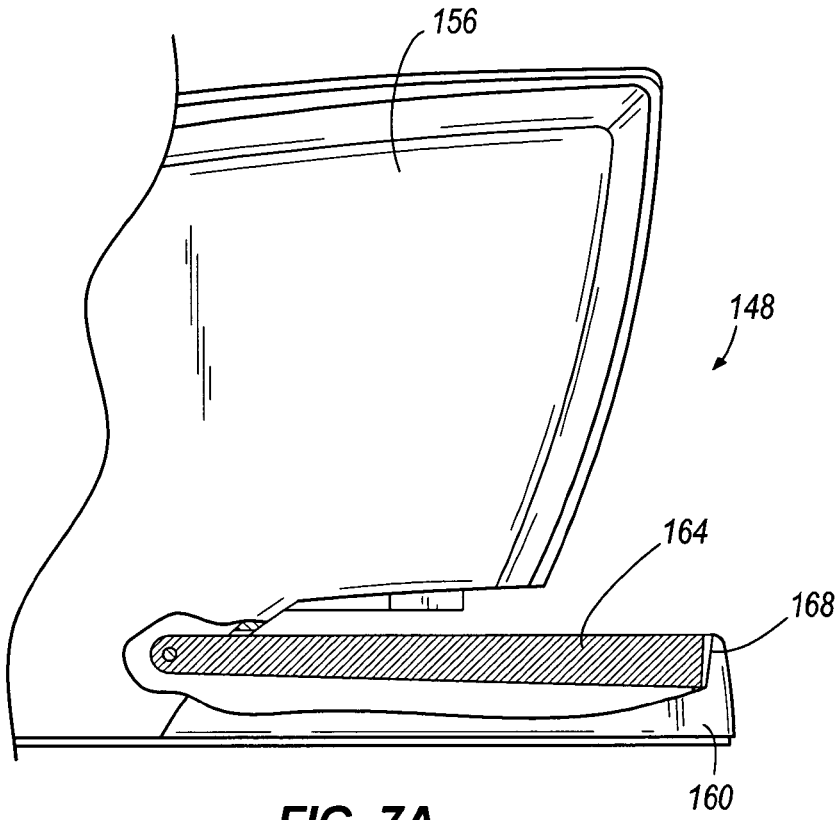
FIG. 7A is a partial section view of the stapler of FIG. 6, with a paper guide shown in the recessed position.
Figure 7B:
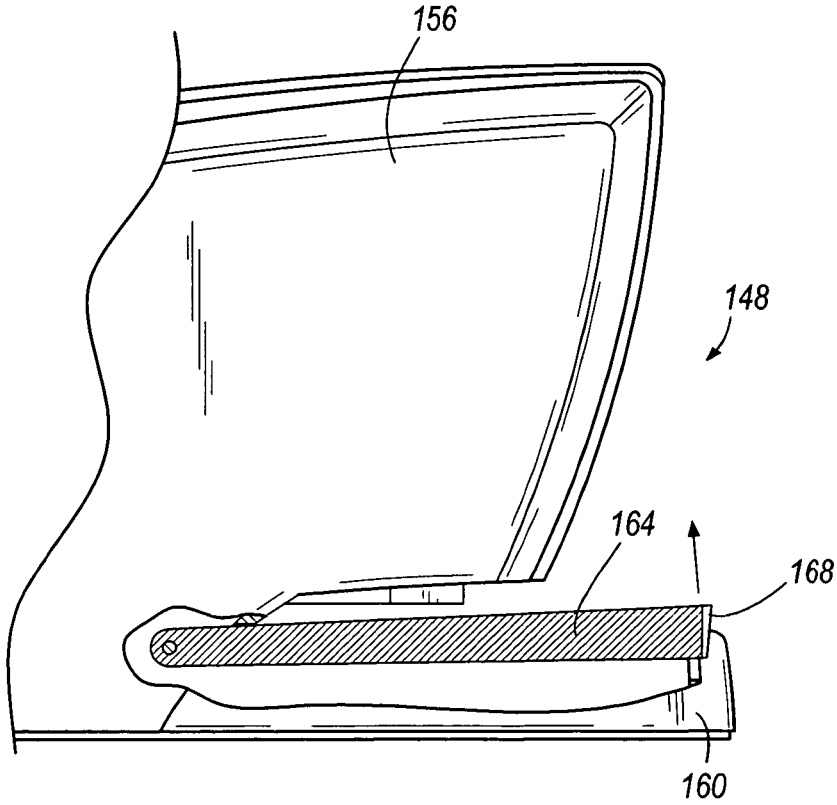
FIG. 7B is the section view of FIG. 7A, with the paper guide shown in the upright position.

FIGS. 6-7B illustrate another stapler 148 according to the present invention. The stapler 148 is fully automatic, and includes a trigger (not shown), such as the internal switch 68 or photosensor described above, for actuating a staple. The stapler 148 includes a housing 152 having an upper head portion 156 and a base portion 160 having a front surface 162. A paper guide 164 is coupled to the stapler 148 within the base portion 160 and can be manually moved between a recessed position, shown in FIG. 7A, and an extended position shown in FIG. 7B. The paper guide 164 includes a front portion 168 that is angled downwardly from the top of the paper guide 164 to the bottom and protrudes outwardly from the front surface 162 of the base portion 160.

To move the paper guide 164 into the upright position, the user simply lifts the paper guide 164 into the extended position by pushing upwardly on the front portion 168 of the paper guide 164. The paper guide 164 is held in the extended position due to the frictional engagement between the guide 164 and the base portion 160. To move the paper guide 164 back into the recessed position, the user simply pushes down on the paper guide 164 to overcome the frictional engagement between the guide 164 and the base portion 160.

Figure 8A:
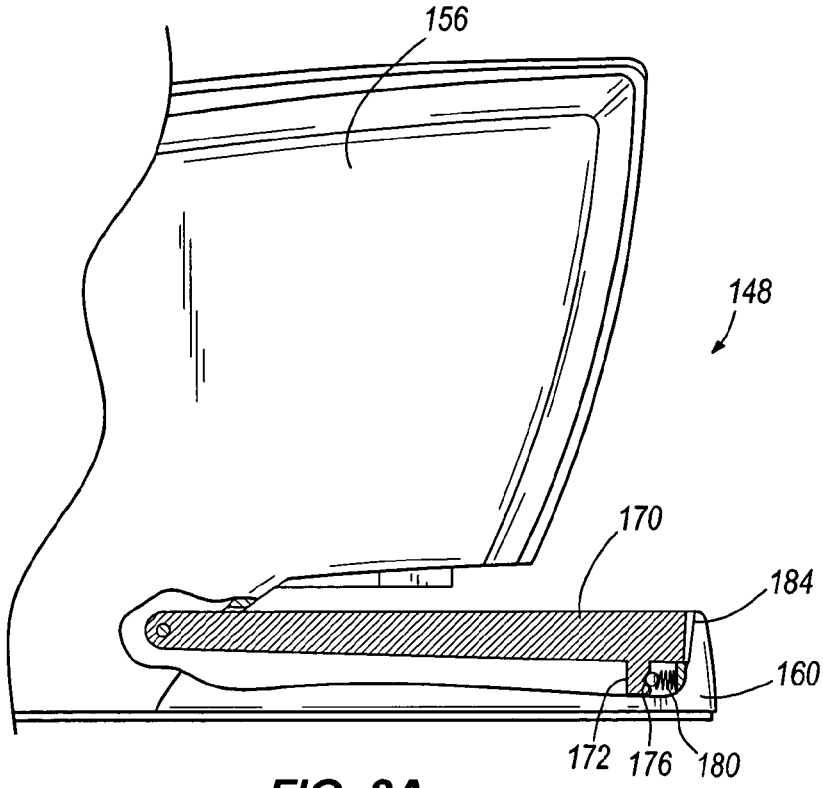
FIG. 8A is a section view of an alternative paper guide, shown in the recessed position.
Figure 8B:
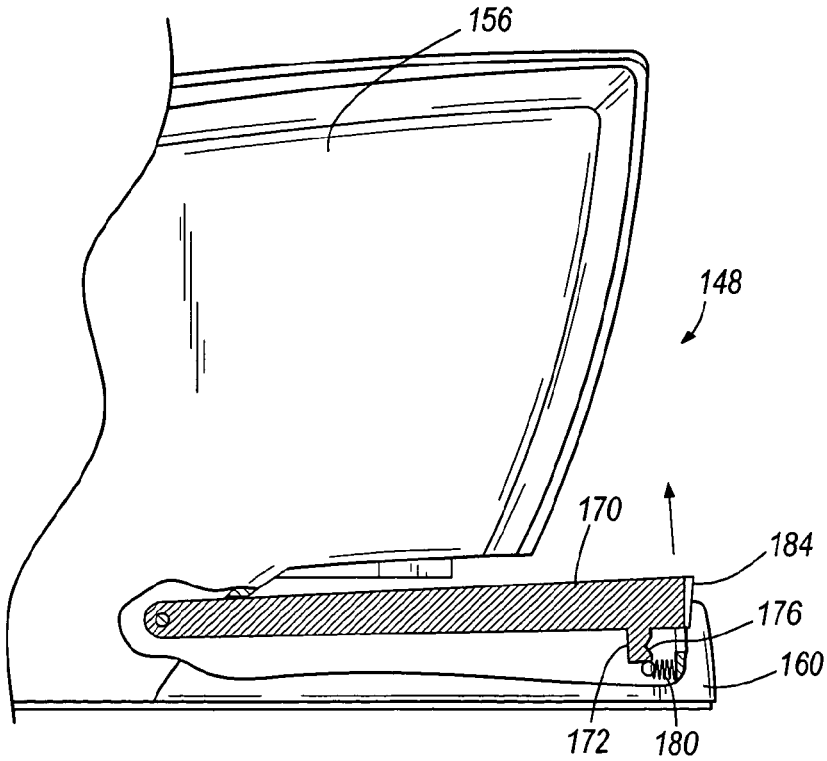
FIG. 8B is the section view of FIG. 8A, with the paper guide shown in the upright position.

FIGS. 8A and 8B illustrate another paper guide 170 to be used with the stapler 148 of FIG. 6. In the illustrated embodiment, the paper guide 170 includes a tab 172 that extends downwardly from the paper guide 170. The tab 172 includes a detent 176 that cooperates with a ball and spring mechanism 180 that is mounted to the base portion 160 of the housing. When the paper guide 170 is in the recessed position, as shown in FIG. 8A, the ball and spring mechanism 180 cooperates with the detent 176 on the tab 172 to hold the paper guide 170 in the recessed position.

When the user wishes to move the paper guide 170 into the extended position, shown in FIG. 8B, the user pushes upwardly on a front portion 184 of the paper guide 170. The upward force overcomes the spring force on the ball and spring mechanism 180 to release the mechanism 180 from the detent 176. Once the paper guide 170 is in the extended position, the bottom surface of the tab 172 rests on the ball and spring mechanism 180, holding the paper guide 170 in the upright position. To move the paper guide 170 back into the recessed position, the user pushes down on the paper guide 170, and the tab 172 acts as a cam surface along which the ball and spring mechanism 180 rides, causing the spring to compress until the detent 176 is again in the position to receive the ball and spring mechanism 180.

Figure 9:
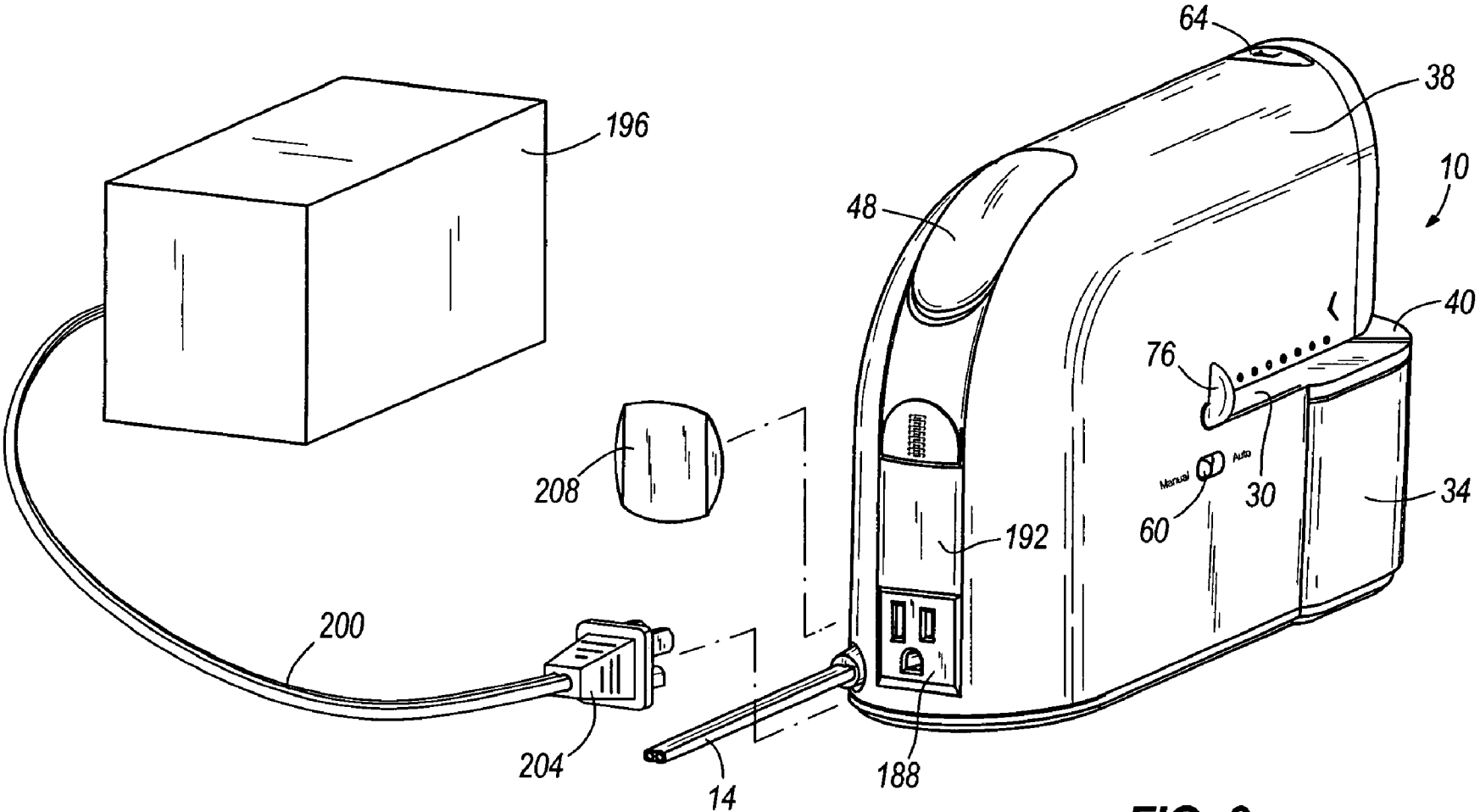
FIG. 9 is a rear perspective view of the stapler of FIG. 1.

FIG. 9 illustrates a rear view of the stapler of FIG. 1 including yet another feature of the invention. In this embodiment, the stapler 10 includes an extra outlet 188 on a rear surface 192 of the stapler 10. The outlet 188 allows another electrical appliance 196 to be plugged into, and therefore powered by, the stapler 10. The electrical appliance 196 includes a cord 200 having an electrical plug 204 on the end that is inserted into the outlet 188. The electrical appliance 196 could include, but is not limited to, a lamp, a radio, a clock, an electric pencil sharpener, or any other electrical device that might be used in the same vicinity as the stapler 10. When the outlet 188 is not in use, the outlet 188 may be closed by inserting a cap 208 into the outlet 188.

FIGS. 10-14A illustrate a stapler 220 including another paper guide mechanism 224 (see FIGS. 12-14A) according to the invention. Components of the stapler 220 in FIGS. 10-14A that are the same as components of the stapler 10 in FIG. 1 will be given the same reference numerals and will not be described in detail below.

With reference to FIGS. 12-14A, the paper guide mechanism 224 includes paper guides 228 housed within the base portion 34. As shown in the illustrated embodiment, there are four paper guides 228A-228D housed within the base portion 34, though it is understood that more or fewer paper guides 228 can be utilized in other embodiments of the invention. The stapler 220 also includes a lighted paper guide 230 within the support surface 40 of the base portion 34. The construction of the lighted paper guide 230 is described in detail in co-pending U.S. patent application No. 11/110,642, entitled "Stapler," the entire contents of which is incorporated by reference herein.

Figure 10:
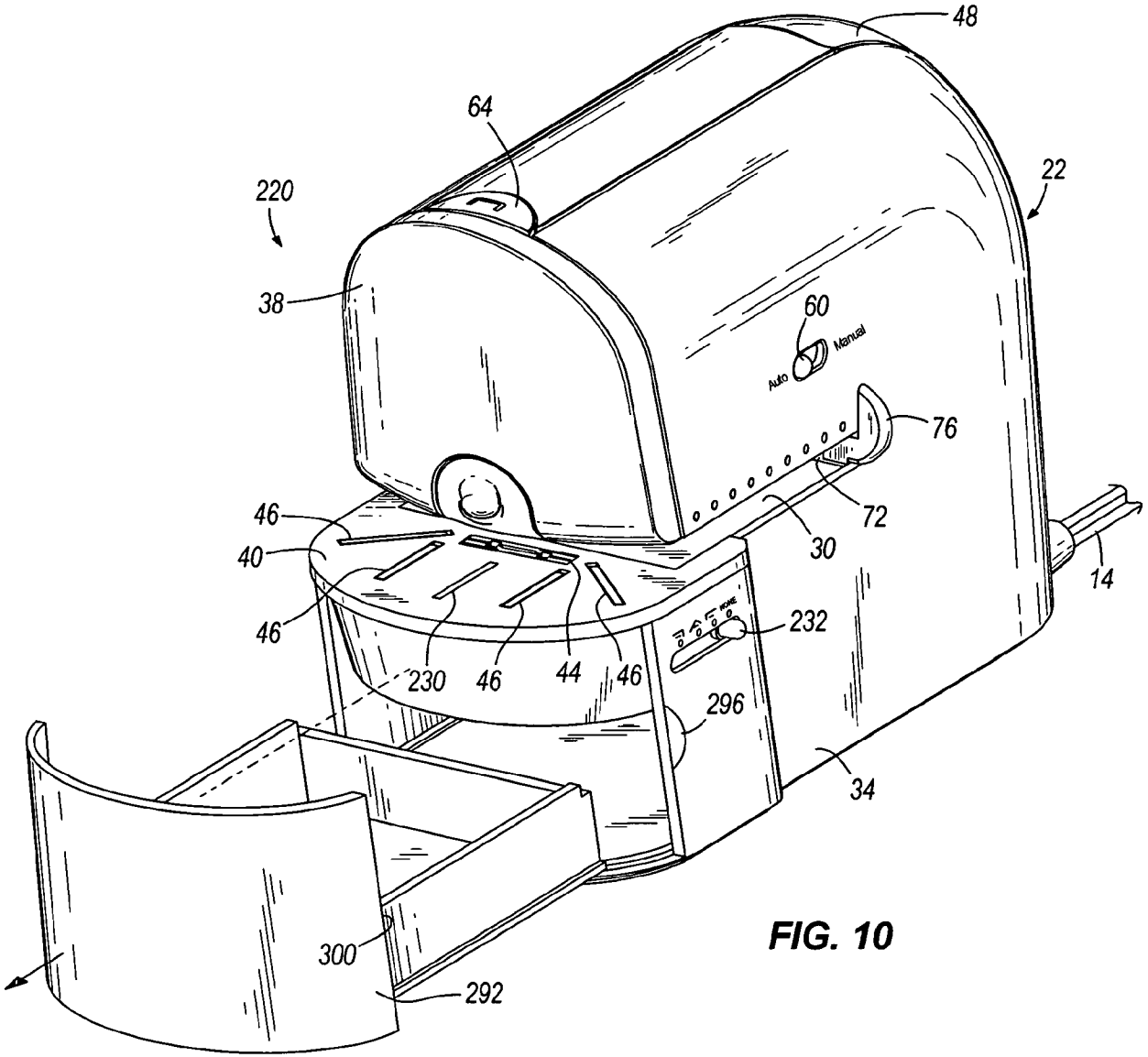
FIG. 10 is a perspective view of a stapler according to another embodiment of the invention.
Figure 11:
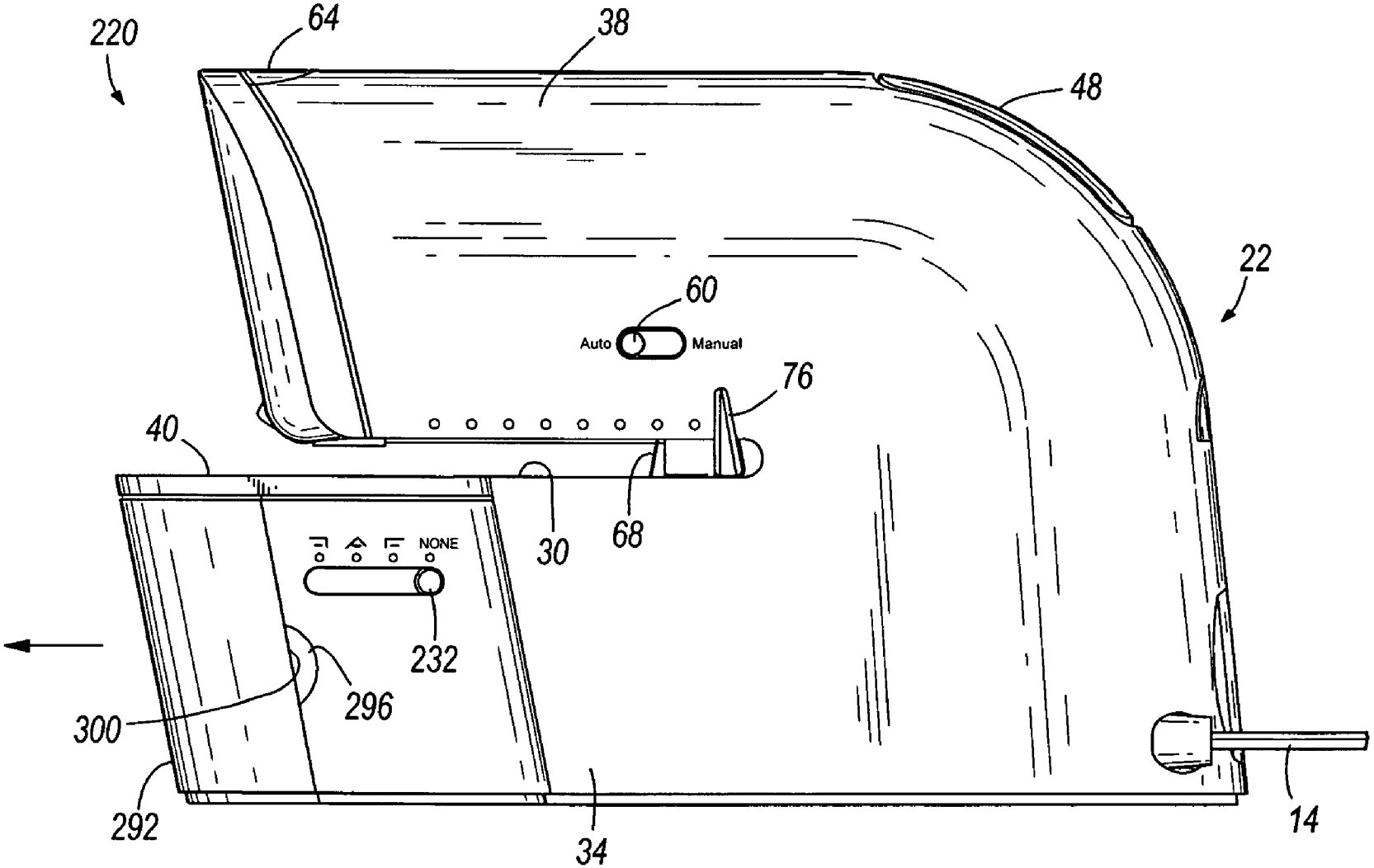
FIG. 11 is a side view of the stapler of FIG. 10.
Figure 12:
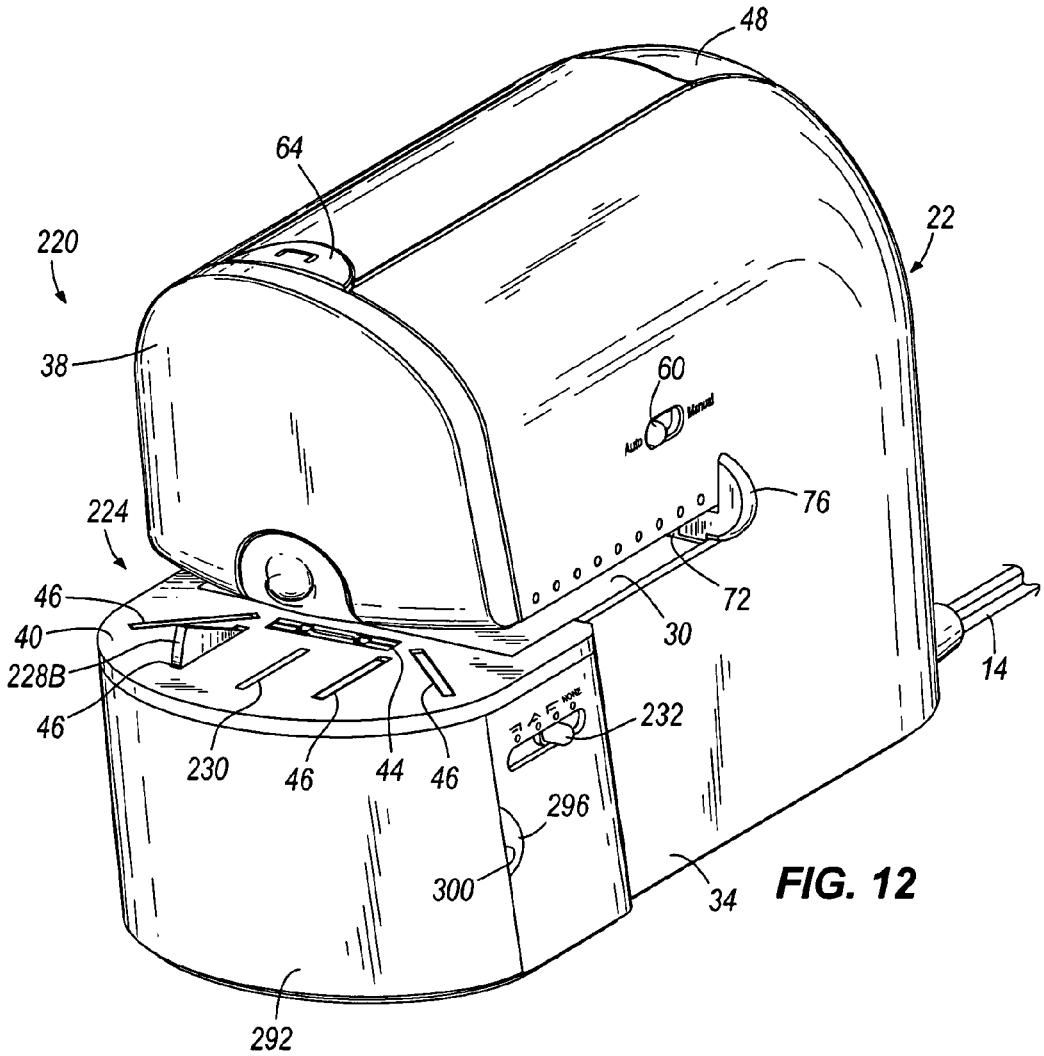
FIG. 12 is a perspective view of the stapler of FIG. 10 with a paper guide in a first position.
Figure 12A:
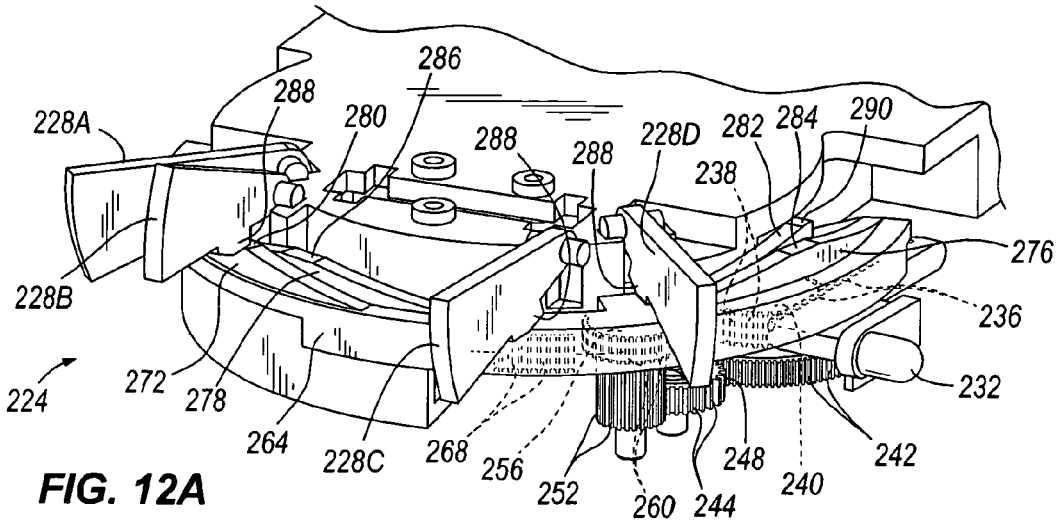
FIG. 12A is a partial cutaway view of the internal components of the paper guide of FIG. 12.
Figure 13:
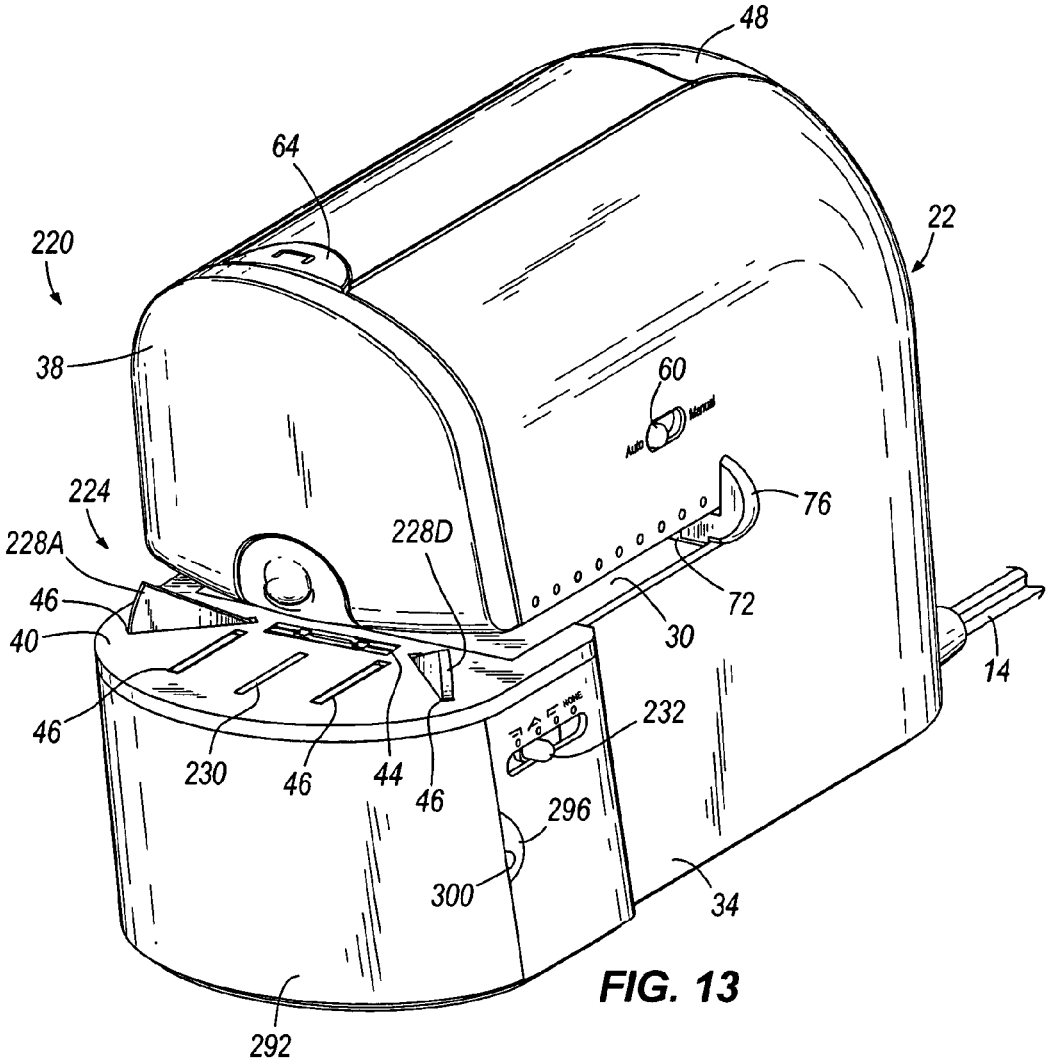
FIG. 13 is a perspective view of the stapler of FIG. 10 with the paper guide in a second position.
Figure 13A:
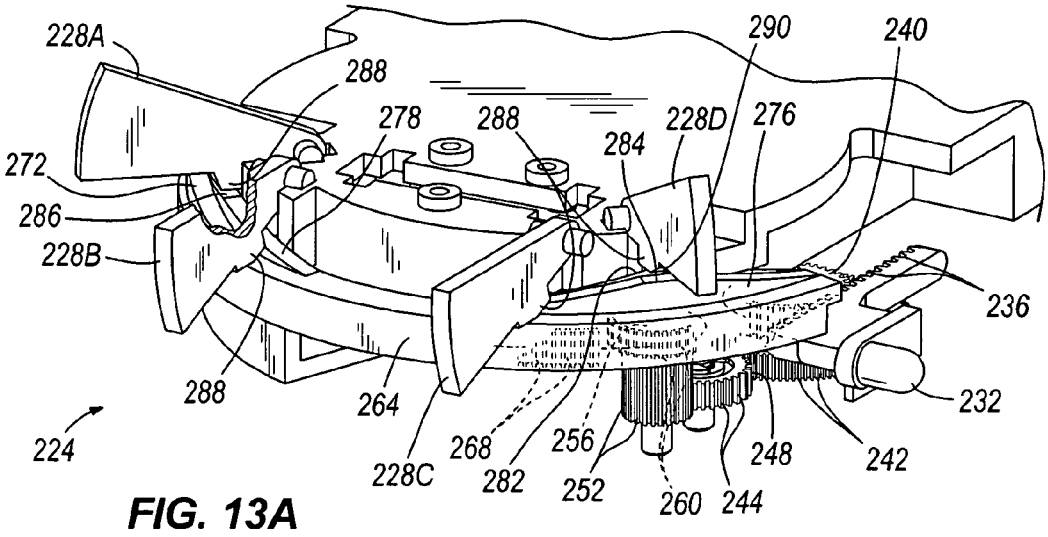
FIG. 13A is a partial cutaway view of the internal components of the paper guide of FIG. 13.
Figure 14:
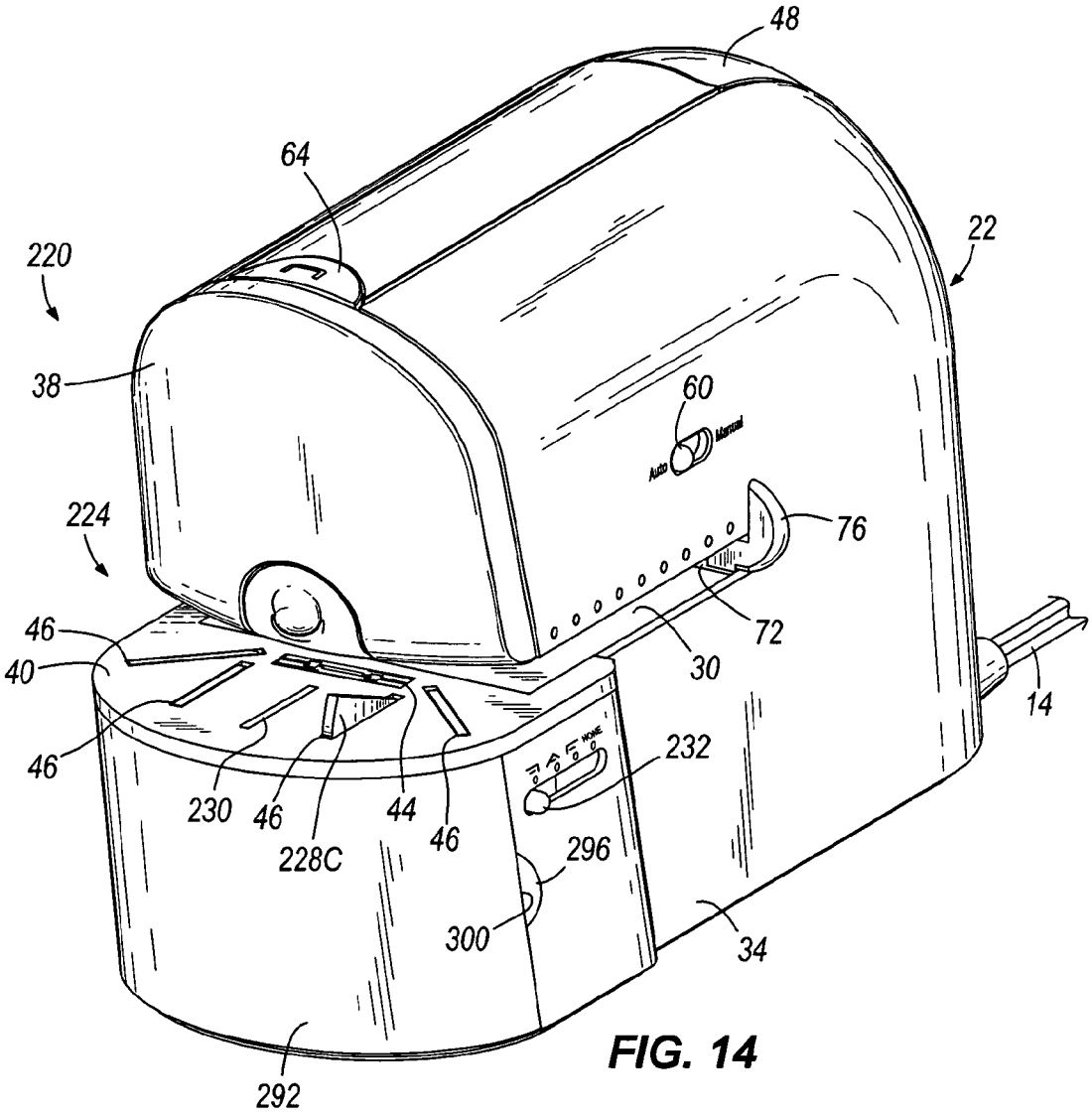
FIG. 14 is a perspective view of the stapler of FIG. 10 with the paper guide in a third position.
Figure 14A:
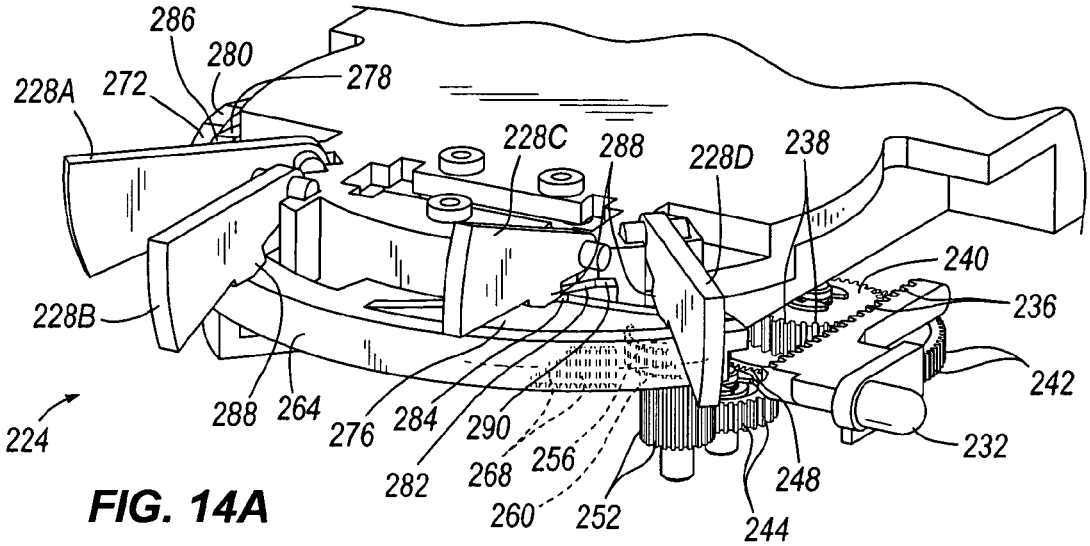
FIG. 14A is a partial cutaway view of the internal components of the paper guide of FIG. 14.

The paper guides 228A-228D are movable between a first configuration, illustrated in FIGS. 12 and 12A, a second configuration, illustrated in FIGS. 13 and 13A, a third configuration, illustrated in FIGS. 14 and 14A, and a fourth configuration, illustrated in FIGS. 10 and 11. A user can move the paper guides 228A-228D between the first through fourth configurations by moving a position switch 232 that protrudes from the base portion 34 of the stapler 220.

The first through fourth configurations discussed above allow the user to control the placement of a staple within the stack of sheets to be stapled. In the illustrated embodiment, the first configuration corresponds to an upper left corner horizontal staple orientation, the second configuration corresponds to a forty-five degree corner staple orientation, and the third configuration corresponds to an upper right corner horizontal staple orientation. As best illustrated in FIG. 11, these staple orientations are illustrated pictorially just above the position switch 232 on the base 34 of the stapler 220 as a reference for the user. In the fourth configuration, illustrated in FIGS. 10 and 11, the paper guides 228A-228D remain recessed within the staple base 34 to allow for any staple orientation desired by the user. It is understood that while the staple orientations discussed above are described with respect to the first through fourth configurations of the illustrated embodiment, other staple orientations using the paper guides 228A-228D of the invention are possible, and thus the paper guides 228A-228D are not limited to the described configurations. For example, the first configuration of the paper guides 228A-228D can also be utilized to obtain an upper right corner vertical staple orientation, and the third configuration can be utilized to obtain an upper left corner vertical staple orientation.

FIGS. 12A, 13A, and 14A illustrate the inner components of the paper guide mechanism 224 in each of the first, second, and third configurations, respectively. The position switch 232 includes internal teeth 236 that intermesh with upper teeth 238 of a first rotating gear 240 such that movement of the position switch 232 causes rotation of the first rotating gear 240. The first rotating gear 240 is the first of three gears in a gear train that function to move the paper guides 228A-228D through the different configurations described above.

Lower teeth 242 of the first rotating gear 240 intermesh with teeth 244 of a second rotating gear 248. The lower teeth 244 of the second rotating gear 248 intermesh with the lower teeth 252 of a third rotating gear 256. The third rotating gear 256 also includes a set of upper teeth 260. Due to the intermeshing of the teeth on the first, second, and third rotating gears 240, 248, 256, movement of the position switch 232 is translated into movement of all three gears 240, 248, 256 (i.e., movement of the gear train).

The paper guide mechanism 224 also includes a rotating cam member 264. The cam member 264 includes internal teeth 268 that intermesh with the upper teeth 260 of the third rotating gear 256. The cam member 264 also includes a first ramped portion 272 and a second ramped portion 276. Each of the ramped portions 272, 276 includes an apex 280, 284. The cam member 264 also includes a third ramped portion 278 and a fourth ramped portion 282 that are spaced radially inwardly from the first and second ramped portions 272, 276, respectively. Each of the third and fourth ramped portions 278, 282 also include an apex 286, 290. It is understood that while the third and fourth ramped portions 278, 282 of the illustrated embodiment are radially spaced from the first and second ramped portions 272, 276, in other embodiments of the invention the third and fourth ramped portions can be located in the same radial position on the cam member 264 as the first and second ramped portions. In still other embodiments, the configuration of the first and second ramped portions can be lengthened or changed such that the third and fourth ramped portions are no longer necessary to actuate the paper guides. Each of the paper guides 228 includes a downwardly extending tab 288 that cooperates with the cam member 264, as will be discussed in more detail below.

The base portion 34 also includes a removable storage tray 292 that can be used to store extra staples for the stapler or other office supplies. The user can remove the storage tray 292 by grasping the tray 292 at the indentations 296 on the base 34 that are designed to receive the fingers of the user. The indentations 296 allow the user to grasp the rearward edges 300 of the tray 292 and pull the tray forward, as illustrated in FIG. 10, to expose the contents of the storage tray 292 when desired.

The paper guide mechanism 224 described above can be operated according to the following method. When the user desires an upper left corner horizontal staple orientation or an upper right corner vertical staple orientation, the user moves the position switch 232 from the fourth configuration (shown in FIGS. 10 and 11) to the first configuration (shown in FIGS. 12 and 12A). Moving the position switch 232 causes rotation of the first rotating gear 240, which in turn causes rotation of the second rotating gear 248, the third rotating gear 256, and the cam member 264 due to the interaction of the teeth on the gears and the cam member 264. Moving from the fourth to the first configuration causes the cam member 264 to rotate thirty degrees in the clockwise direction.

As the cam member 264 rotates, the first ramped portion 272 moves under the paper guide 228B, such that the tab 288 moves up the ramped portion 272 and rests on the apex 280. Thus, the paper guide 228B extends through the aperture 46 in the support surface 40. The user then guides the stack of sheets to be stapled along an inner face of the paper guide 228B into the throat 30 until the stack abuts the throat depth adjuster 72. If the stapler 220 is in the manual mode, the user then presses the stapling button 64 to drive a staple into the stack of sheets. If the stapler 220 is in the automatic mode, the stack of sheets will trigger the actuation of the staple upon making contact with the internal switch 68 on the throat depth adjuster 72, as is described above.

When the user desires a forty-five degree corner staple placement, the user moves the position switch 232 to the second configuration (shown in FIGS. 13 and 13A), causing the cam member 264 to rotate another thirty degrees. The tab 288 of the paper guide 228A interacts with the apex 286 of the third ramped portion 278 to push the paper guide 228A up and through the support surface 40 into the extended position. The tab 288 of the paper guide 228D interacts with the apex 290 of the fourth ramped portion 282 to push the paper guide 228D up and through the support surface 40 into the extended position. The paper guide 228B slides down off of the ramped portion 272 as the cam member 264 rotates to that the paper guide 228B no longer extends through the support surface 40. The user can then insert a corner of a stack of sheets between the paper guides 228A, 228D to achieve a forty-five degree angle staple orientation in the stack.

Moving the position switch 232 to the third configuration (shown in FIGS. 14 and 14A) causes another thirty degree rotation of the cam member 264. Thus, moving through all the positions of the position switch 232 results in a ninety degree rotation of the cam member 264. The rotation of the cam member 264 causes an interaction between the tab 288 of the paper guide 228C and the second ramped portion 276. Specifically, the tab 288 rests on the apex 284 to push the paper guide 228C up through the aperture 46 in the support surface 40 into the extended position. The paper guides 228A, 228D disengage the ramped portions 278, 282 as the cam member 264 rotates such that the paper guides 228A, 228D no longer extend through the support surface 40. Thus, the user can utilize the paper guide 228C to achieve an upper right corner horizontal staple orientation or an upper left corner vertical staple orientation. When no paper guides 228A-228D are desired, the position switch 232 is moved back to the fourth configuration such that the paper guides 228A-228D remain recessed within the base 34.

Various features of the invention are set forth in the following claims.

We claim:

1. A stapler comprising:

a housing;

a throat defined by the housing and configured to receive a stack of sheets for stapling, the throat separating the housing into a head portion and a base portion, the base portion including a sheet support surface; and a paper guide coupled to the stapler, the paper guide movable between a recessed position in which the paper guide is recessed in one of the base portion and the head portion and does not extend into the throat and an extended position in which the paper guide extends into the throat via movement having at least a component in a direction normal to the sheet support surface;

wherein insertion of the stack of sheets into the throat does not cause movement of the paper guide.

2. The stapler of claim 1, wherein movement of the paper guide results from engagement of the paper guide with another portion of the stapler.

3. The stapler of claim 2, wherein the another portion of the stapler includes a ramped surface.

4. The stapler of claim 2, wherein the another portion of the stapler includes a manually adjustable position switch.

5. The stapler of claim 1, further comprising an adjustable throat depth guide mounted within the throat.

6. The stapler of claim 5, wherein the adjustable throat guide includes an internal switch thereon such that contact between the internal switch and the inserted stack of sheets causes ejection of a staple from the stapler when the stapler is in an automatic mode.

7. The stapler of claim 1, wherein the paper guide includes first and second paper guides.

8. The stapler of claim 7, wherein the first and second paper guides are independently movable between the recessed and extended positions.

9. The stapler of claim 1, wherein the paper guide includes first, second, third, and fourth paper guides, and wherein each of the first, second, third, and fourth paper guides are independently movable between the recessed and extended positions.

10. The stapler of claim 9, wherein the first, second, third, and fourth paper guides are movable through first, second, third, and fourth paper guide configurations.

11. The stapler of claim 1, further comprising a gear train mounted within the base portion of the stapler, and a cam member coupled to the gear train, wherein rotation of gears within the gear train causes rotation of the cam member, and wherein the cam member engages with the paper guide to move the paper guide between the recessed and extended positions.

12. The stapler of claim 1, wherein the paper guide is recessed in the base portion when in the recessed position.

13. A stapler comprising:

a housing;

a throat defined by the housing and configured to receive a stack of sheets for stapling, the throat separating the housing into a head portion and a base prortion, the base portion including a sheet support surface;

an adjustable throat depth guide mounted within the throat for movement in a direction generally parallel to the sheet support surface; and a paper guide coupled to the stapler, the paper guide movable between a recessed position which the paper guide is recessed in one of the base portion and the head portion and does not extend into the throat and an extended position in which the paper guide extends into the throat via movement having at least a component in a direction normal to the sheet support surface;

wherein the paper guide is movable between first and second configurations, the paper guide in the first configuration operable to guide a stack of sheets within the throat to receive a staple in a first staple orientation, and the paper guide in the second configuration operable to guide the stack of sheets within the throat to receive a staple in a second staple orientation.

14. The stapler of claim 13, wherein movement of the paper guide results from engagement of the paper guide with another portion of the stapler.

15. The stapler of claim 14, wherein the another portion of the stapler includes a ramped surface.

16. The stapler of claim 14, wherein the another portion of the stapler includes a manually adjustable position switch.

17. The stapler of claim 13, wherein the paper guide includes first and second paper guides.

18. The stapler of claim 17, wherein the first and second paper guides are independently movable between the recessed and extended positions.

19. The stapler of claim 13, wherein the paper guide includes first, second, third, and fourth paper guides, and wherein each of the first, second, third, and fourth paper guides are independently movable between the recessed and extended positions.

20. The stapler of claim 19, wherein the first, second, third, and fourth paper guides are movable through first, second, third, and fourth paper guide configurations.

21. The stapler of claim 13, further comprising a gear train mounted within the base portion of the stapler, and a cam member coupled to the gear train, wherein rotation of gears within the gear train causes rotation of the cam member, and wherein the cam member engages with the paper guide to move the paper guide between the recessed and extended positions.

22. The stapler of claim 13, wherein the paper guide is recessed in the base portion when in the recessed position.

23. A stapler comprising:

a housing;

a throat defined by the housing and configured to receive a stack of sheets for stapling, the throat separating the housing into a head portion and a base portion, the base portion including a sheet support surface;

first and second paper guides coupled to the stapler, the paper guides movable between a recessed position in which the paper guide are recessed in one of the base portion and the head portion and do not extend into the throat and an extended position in which the paper guides extend into the throat via movement having at least a component in a direction normal to the sheet support surface; and a position switch operable to move the paper guides between first and second configurations, the first paper guide being in the extended position in the first configuration, the second paper guide being in the extended position in the second configuration.

24. The stapler of claim 23, wherein movement of the paper guide results from engagement of the paper guide with another portion of the stapler.

25. The stapler of claim 24, wherein the another portion of the stapler includes a ramped surface.

26. The stapler of claim 24, wherein the another portion of the stapler includes a manually adjustable position switch.

27. The stapler of claim 23, further comprising an adjustable throat depth guide mounted within the throat.

28. The stapler of claim 23, wherein the paper guide includes first, second, third, and fourth paper guides, and wherein each of the first, second, third, and fourth paper guides are independently movable between and extended positions.

29. The stapler of claim 28, wherein the first, second, third, and fourth paper guides are movable through first, second, third, and fourth paper guide configurations.

30. The stapler of claim 23, further comprising a gear train mounted within the base portion of the stapler, and a cam member coupled to the gear train, wherein rotation of gears within the gear train causes rotation of the cam member, and wherein the cam member engages with the paper guide to move the paper guide between the recessed and extended positions.

31. The stapler of claim 23, wherein the paper guides are recessed in the base portion when in the recessed position.

* * * * *

UNITED STATES PATENT AND TRADEMARK OFFICE

CERTIFICATE OF CORRECTION

PATENT NO. : 7,306,131 B2
APPLICATION NO. : 11/110644
DATED : December 11, 2007
INVENTOR(S) : Bargo et al.

It is certified that error appears in the above-identified patent and that said Letters Patent is hereby corrected as shown below:

Claim 13, Column 9, Line 42, after “position” and before “which” insert --in--.

Claim 23, Column 10, Line 27, after “paper” and before “are” replace “guide” with --guides--.

Signed and Sealed this

Twenty-seventh Day of May, 2008

JON W. DUDAS
*Director of the United States Patent and Trademark Office*